US005622521A

United States Patent [19]

Marceau et al.

[11] Patent Number: 5,622,521

[45] Date of Patent: Apr. 22, 1997

[54] ELECTRICAL CONNECTOR WITH TERMINAL POSITION ASSURANCE DEVICE THAT FACILITATES FULLY INSERTING A TERMINAL

[75] Inventors: Scott P. Marceau, Plainfield; Kenneth T. Stead, Aurora, both of Ill.

[73] Assignee: Molex Incorporated, Lisle, Ill.

[21] Appl. No.: 552,323

[22] Filed: Nov. 2, 1995

Related U.S. Application Data

[63] Continuation-in-part of Ser. No. 314,981, Sep. 29, 1994, Pat. No. 5,522,740.

[51] Int. Cl.[6] ..... H01R 13/432

[52] U.S. Cl. ..... 439/595

[58] Field of Search ..... 439/752, 595

[56] References Cited

U.S. PATENT DOCUMENTS

| | | | |
|---|---|---|---|
| Re. 34,539 | 2/1994 | Aoyama | 439/752 |
| 4,557,542 | 12/1985 | Coller et al. | 339/59 |
| 4,944,688 | 7/1990 | Lundergan | 439/275 |
| 4,955,827 | 9/1990 | Roy et al. | 439/595 |
| 5,120,286 | 6/1992 | Endo et al. | 439/752 |
| 5,160,283 | 11/1992 | Fry et al. | 439/752 |
| 5,186,662 | 2/1993 | Yuasa et al. | 439/752 |
| 5,205,763 | 4/1993 | Watanabe et al. | 439/752 |
| 5,209,676 | 5/1993 | Endo et al. | 439/595 |
| 5,281,168 | 1/1994 | Krehbiel et al. | 439/595 |
| 5,299,958 | 4/1994 | Ohsumi | 439/752 |
| 5,437,565 | 8/1995 | Atsumi et al. | 439/752 |
| 5,520,553 | 5/1996 | Cecil, Jr. et al. | 439/595 |

*Primary Examiner*—Gary F. Paumen
*Attorney, Agent, or Firm*—A. A. Tirva

[57] ABSTRACT

An electrical connector includes a housing having a forward mating end and a rearward terminating end and at least one terminal-receiving cavity extending in a direction between the ends. A terminal is insertable into the cavity from the rearward terminating end of the housing. A TPA device is selectively engageable with the housing in two positions, preloaded and fully loaded, at the terminating end of the housing, with a terminal retention portion insertable into the cavity in locking engagement with the terminal. Complementary interengaging abutments are provided between the terminal and the TPA device for moving the terminal from at least one incomplete position of insertion to a fully inserted position in response to moving the TPA device from the preloaded position to the fully loaded position thereof. The TPA device is held on the housing in either of the preloaded position or the fully loaded position thereof in such a manner as to allow the TPA device to be readily removed from the housing along with the terminals therewith.

10 Claims, 10 Drawing Sheets

ELECTRICAL CONNECTOR WITH TERMINAL POSITION ASSURANCE DEVICE THAT FACILITATES FULLY INSERTING A TERMINAL

RELATED APPLICATION

This is a continuation-in-part of application Ser. No. 08/314,981, filed Sep. 29, 1994, U.S. Pat. No. 5,522,740 issued Jun. 4, 1996, and assigned to the assignee of the present application.

FIELD OF THE INVENTION

This invention generally relates to the art of electrical connectors and, particularly, to an electrical connector which incorporates an improved position assurance device that not only detects an incompletely inserted terminal but moves the incompletely inserted terminal to its fully inserted position.

BACKGROUND OF THE INVENTION

Generally, an electrical connector includes a dielectric housing mounting at least one electrically conductive terminal therein. The terminal is electrically connected to another circuit component, such as a discrete wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals. The automotive industry also generally requires locking means for locking the terminals in the housing, and a TPA system or device also performs this function.

In using a typical TPA device, if the device detects that one or more terminals are not fully seated, a search is required to locate the incompletely inserted terminal(s). This can be a time consuming operation and adds to the cost of the connector assembly operation. The present invention is directed to solving this problem by providing a TPA device which not only detects an incompletely inserted terminal, but the device, itself, is used to move the incompletely inserted terminal to its fully inserted position. The invention also is directed to improved features which allow the TPA device, along with the terminals, to be readily removed from the connector housing for service purposes, as well as a structure for reducing the overall size of the connector.

SUMMARY OF THE INVENTION

An object, therefore, of the invention is to provide an electrical connector with a new and improved terminal position assurance (TPA) device of the character described.

In the exemplary embodiment of the invention, the connector includes a housing having a forward mating end and a rearward terminating end and at least one terminal-receiving cavity extending in a direction between the ends. A terminal is insertable into the cavity from the rearward terminating end of the housing. A TPA device is selectively engageable with the housing in two positions, preloaded and fully loaded, at the mating end of the housing, with a terminal retention portion of the device insertable into the cavity in locking engagement with the terminal. Complementary interengaging abutment means are provided between the terminal and the TPA device for moving the terminal from at least one incomplete position of insertion to a fully inserted position in response to moving the TPA device from the preloaded position to the fully loaded position thereof. Complementary interengaging holding means are provided between the TPA device and the housing for holding the TPA device in either of its preloaded and fully loaded positions and allowing the TPA device to be readily removed from the housing along with the terminal therewith.

As disclosed herein, the complementary interengaging holding means includes at least one flexible latch arm cantilevered from a side of the TPA device and releasably engageable with complementary latch means on the housing. Preferably, one of the latch arms are provided on each of two opposite sides of the TPA device for conjoint pinching inwardly by an operator to effect removal of the TPA device and terminal from the housing.

Another feature of the invention involves reducing the overall dimensions of the connector. In particular, the TPA device includes a plurality of longitudinal terminal-receiving passages with at least some of the passages being open lengthwise thereof at least at one side of the TPA device. Some of the terminals are exposed through the open passages at the one side of the TPA device. Blocking means are provided on the housing within the cavity and aligned with the open passages and engageable by the exposed terminals to prevent lateral movement or twisting of the exposed terminals. As disclosed herein, some of the passages are open at each of two opposite sides of the TPA device exposing terminals thereat. The blocking means are provided by elongated ribs integrally formed with the housing within the cavity.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
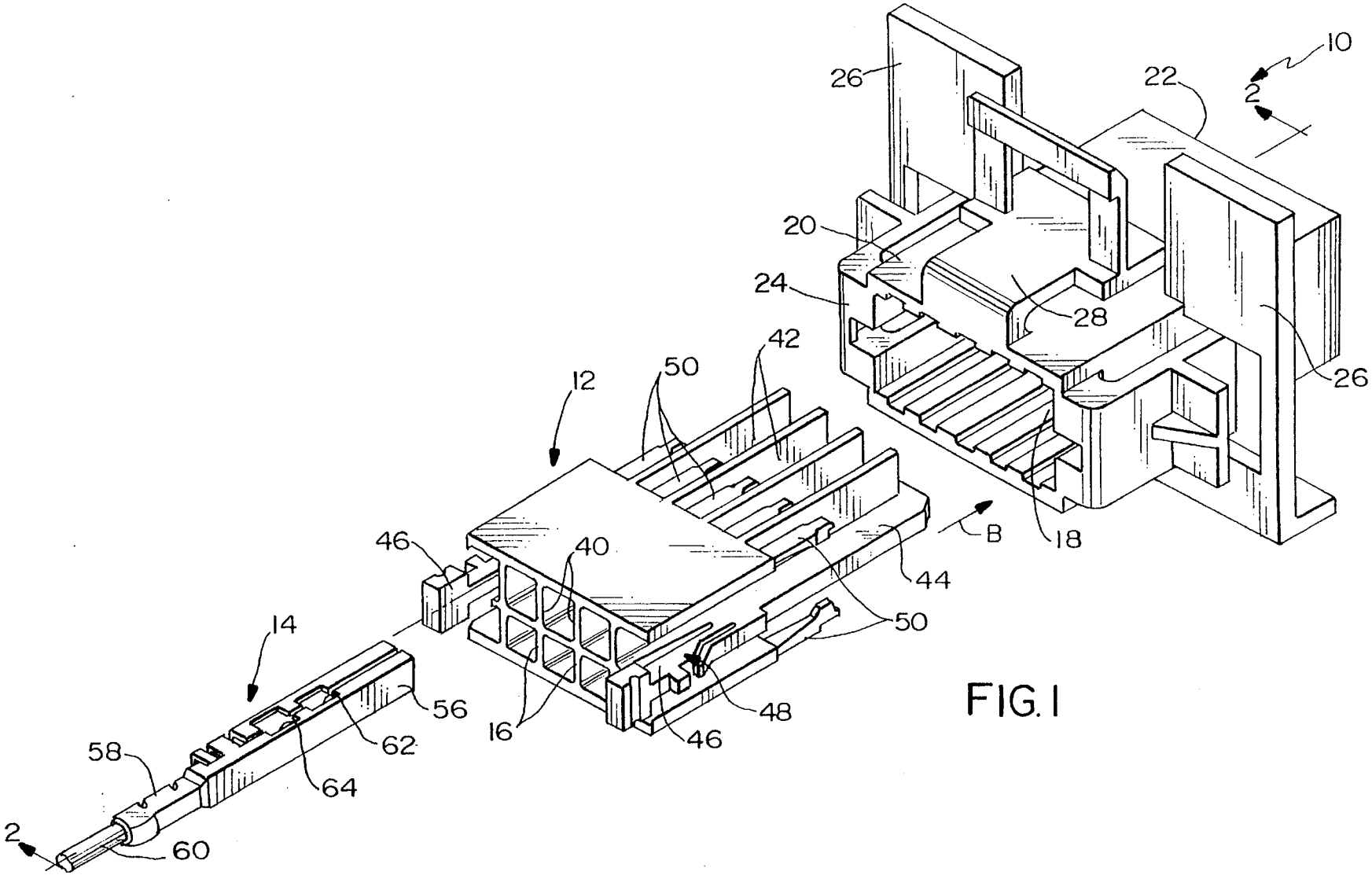
FIG. 1 is an exploded perspective view of an electrical connector assembly, including a TPA device, embodying the concepts of a first embodiment of the invention.
Figure 2:
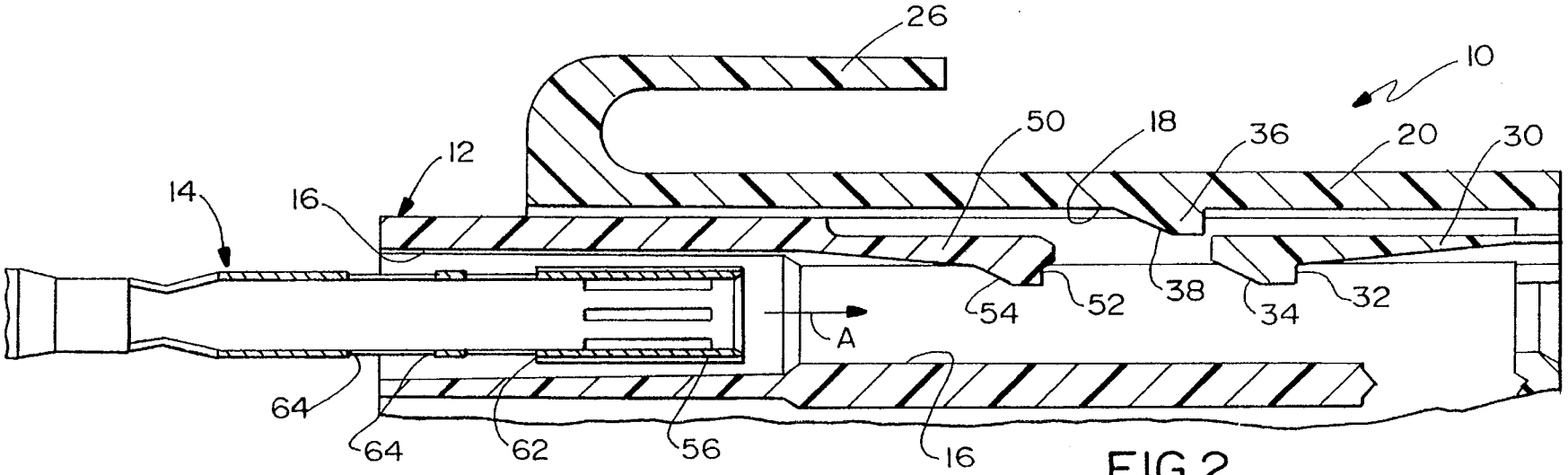
FIG. 2 is a vertical section taken generally along line 2—2 of FIG. 1, but with the TPA device assembled to the connector in its preloaded position and with the terminal just partially inserted.

Referring to the drawings in greater detail, and first to FIGS. 1 and 2, a first embodiment the invention is embodied in an electrical connector, generally designated 10, which includes a TPA device, generally designated 12, selectively engageable with the connector. A plurality of terminals, generally designated 14, are inserted through passages 16 in the TPA device and into a terminal-receiving cavity 18 of the connector. Only one terminal is shown in the drawings to avoid cluttering a clear depiction of the invention. As will be understood hereinafter, TPA device 12 is adapted for insertion into terminal-receiving cavity 18 of connector 10, and terminals 14 then are inserted into passages 16 of the TPA device and further into cavity 18 of the connector.

More particularly, connector 10 includes a housing 20 having a forward mating end 22 and a rearward terminating end 24. The housing is unitarily molded of dielectric material, such as plastic or the like, and cavity 18 extends between mating end 22 and terminating end 24 of the housing. Although not forming part of the invention, connector housing 20 also includes integral side flanges 26 to facilitate mounting the connector in a panel, and latch means 28 for latching the connector to a complementary mating connector or other connecting device.

As seen best in FIG. 2, connector housing 20 has a primary locking means within cavity 18, in the form of a flexible locking arm 30 having a forwardly facing locking shoulder or hook 32. The distal end of the locking arm is chamfered, as at 34, to present a rearwardly facing angled surface to terminal 14 oblique to an insertion direction "A" of the terminal. A camming boss 36 also is formed integral with connector housing 20 within cavity 18. The camming boss also forms a rearwardly facing angled surface 38 extending oblique to insertion direction "A".

Referring back to FIG. 1, TPA device 12 includes rear walls 40 and front partitions 42 for separating terminal-receiving passages 16. It can be seen that there are two rows of passages divided transversely of the TPA device by a central wall 44. Cantilevered latch arms 46 are provided at opposite sides of the TPA device for gripping and squeezing by a technician to facilitate inserting the TPA device into cavity 18 of connector housing 20 in the direction of arrow "B". Latch means, generally designated 48, are provided, operatively associated with latch arms 46, for latching the TPA device within the cavity in cooperation with complementary latching means (not shown) therewithin.

Referring to FIG. 2 in conjunction with FIG. 1, TPA device 12 includes a flexible locking arm 50 located within and projecting forwardly of each terminal-receiving passage 16. The locking arm has a forwardly facing abutment shoulder 52 on the distal end thereof. A chamfered surface 54 faces rearwardly behind the distal end of the locking arm at an angle to insertion direction "A" of the terminal.

Terminal 14 has a forward mating end 56 and a rearward terminating end 58. The forward mating end is generally box-shaped for defining a receptacle to receive a mating male terminal of the complementary connecting device. Terminating end 58 is adapted for crimping onto an electrical wire or cable 60. The terminal includes a forward locking aperture 62 adapted for locking engagement with primary locking arm 30 within cavity 18 of connector housing 20. The terminal includes a second or rear locking aperture 64 for locking engagement with locking arm 50 of TPA device 12 within passage 16 of the device. It should be observed in FIG. 1 that forward locking aperture 62 is smaller in a transverse direction than rear locking aperture 64. To that end, the distal end of locking arm 50 of the TPA device (i.e. at locking shoulder 52 and chamfered surface 54) is wider than forward locking aperture 62 so that the locking arm of the TPA device simply will ride over the top surface of the terminal past forward locking aperture 62. In turn, the forward locking aperture is sized for receiving the forward hooked end of primary locking arm 30.

In operation of the invention, including connector 10, TPA device 12 and terminal(s) 14, FIG. 2 shows the TPA device selectively engaged with connector housing 20, inserted into cavity 18 and located in a preloaded position of the TPA device. Terminal 14 is shown being initially inserted into passage 16 of the TPA device.

Figure 3:
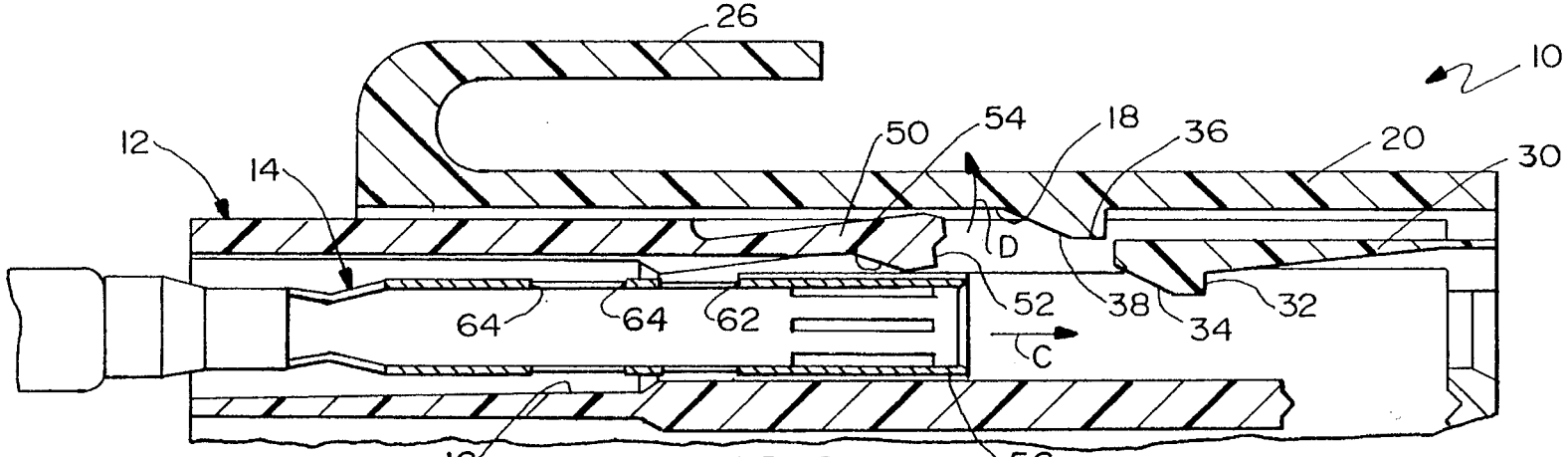
FIG. 3 is a view similar to that of FIG. 2, but with the terminal inserted further such that the mating end thereof is in engagement with and deflecting the locking arm of the TPA device.

FIG. 3 shows terminal 14 having been inserted further in the direction of arrow "C" to a point whereat the mating end 56 of the terminal has biased flexible locking arm 50 upwardly in the direction of arrow "D". The arm is flexed upwardly by the mating end of the terminal engaging chamfered surface 54 of the locking arm. It should be noted that there is adequate space within cavity 18 for the locking arm of the TPA device to fully flex while the device is in its preloaded position.

Figure 4:
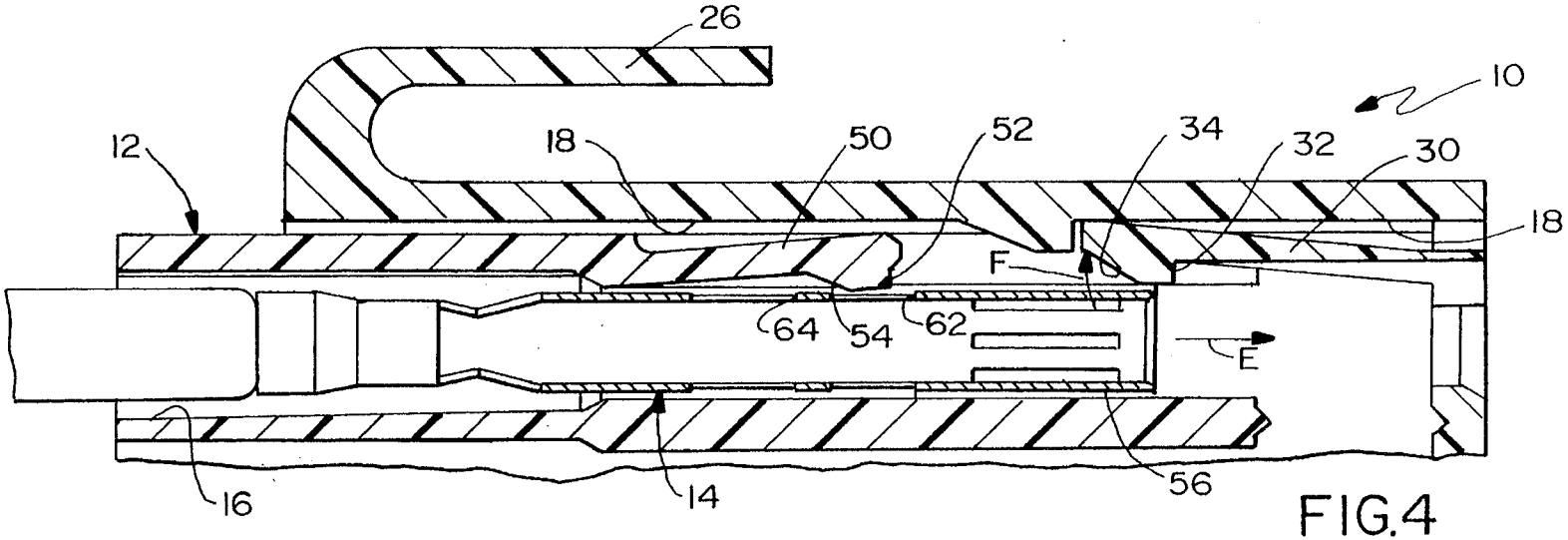
FIG. 4 is a view similar to that of FIG. 3, but with the terminal inserted further to a position of engagement with the primary locking arm of the connector.

FIG. 4 shows terminal 14 having been inserted further in the direction of arrow "E" whereat the mating end 56 of the terminal now has engaged primary locking arm 30 and has flexed the locking arm upwardly in the direction of arrow "F". The arm is flexed upwardly by engagement of the mating end of the terminal with chamfered surface 34 of the primary locking arm. It also can be seen in FIG. 4 that locking arm 50 of TPA device 12 has not dropped into forward locking aperture 62 of the terminal, because, as stated above, the distal end of the locking arm is wider than the smaller aperture and simply will ride over the aperture along the top surface of the terminal.

Figure 5:
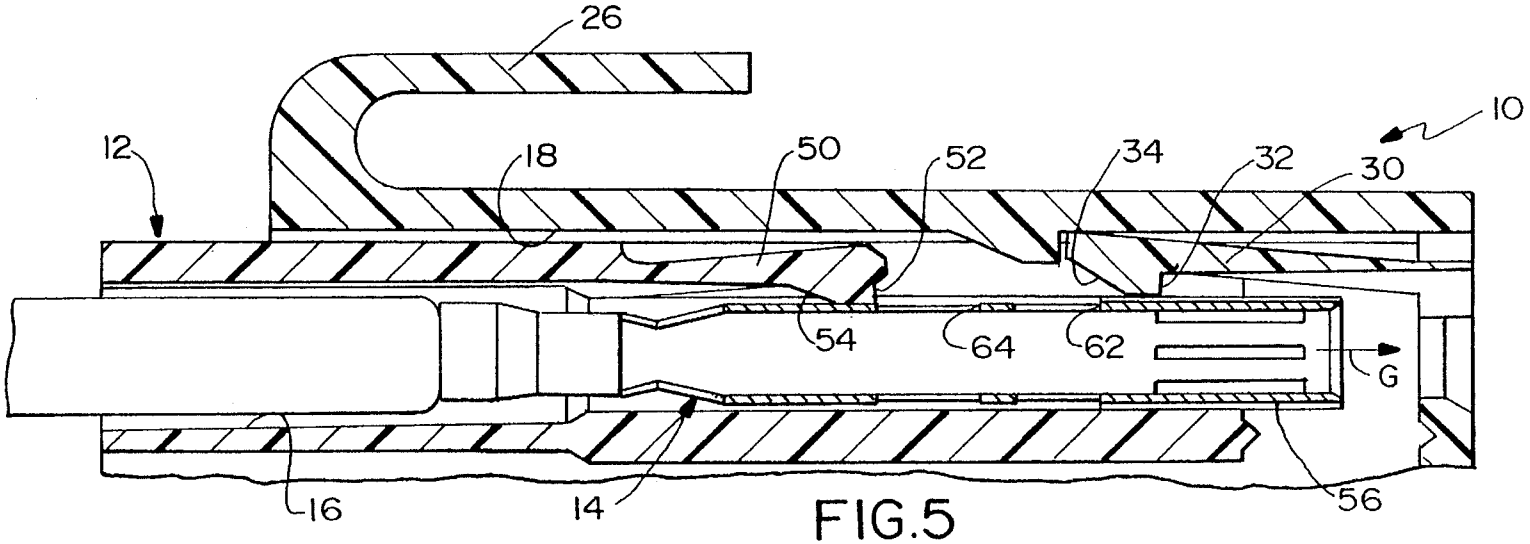
FIG. 5 is a view similar to that of FIG. 4, but with the terminal inserted further to a position wherein both apertures in the terminal have passed the locking arm of the TPA device.

FIG. 5 shows terminal 14 having been inserted still further in the direction of arrow "G" but not yet to its fully inserted position. TPA device 12 still is in its preloaded position, and primary locking arm 30 of connector 10 and locking arm 50 of the TPA device still are in their flexed positions.

Figure 6:
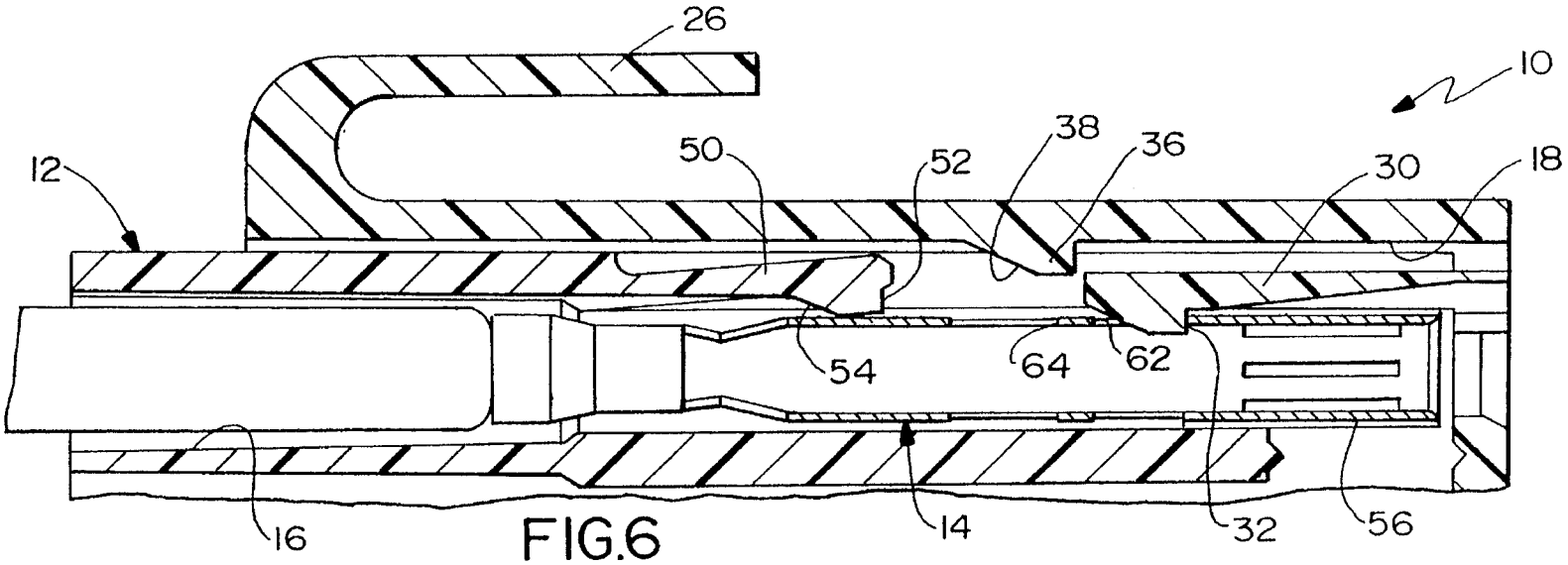
FIG. 6 is a view similar to that of FIG. 5, but with the terminal in its fully inserted position in engagement with the primary locking arm of the connector.

FIG. 6 now shows terminal 14 having been inserted to its fully inserted position. Primary locking arm 30 now has returned or "snapped" back downwardly such that locking shoulder 32 now has interengaged into locking condition within forward locking aperture 62 of the terminal. The TPA device still is in its preloaded position.

Figure 7:
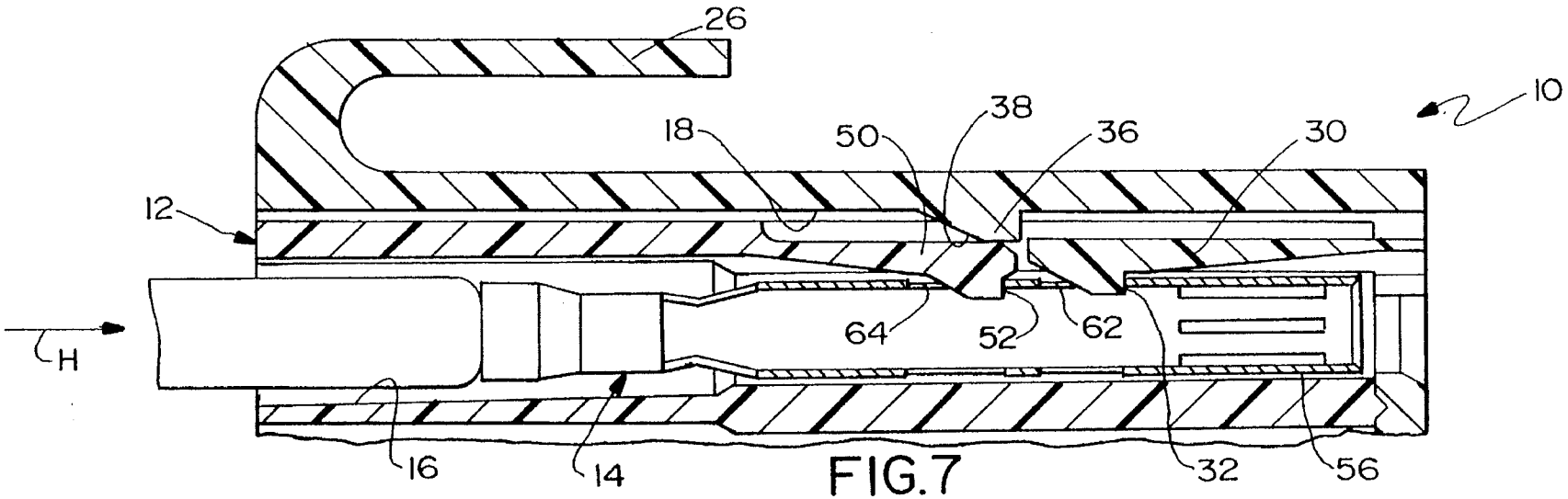
FIG. 7 is a view similar to that of FIG. 6, but with the TPA device moved to its fully loaded position.

FIG. 7 is similar to FIG. 6 in that the terminal is in its fully inserted position in locking engagement with primary locking arm 30. However, TPA device 12 now has been moved in the direction of arrow "H" to its fully loaded and locking position. It can be seen that locking arm 50 of the TPA device has returned or "snapped" back to its unflexed condition, and abutment shoulder 52 is in locking position within rear aperture 64 of the terminal. During movement of the TPA device from its preloaded position (FIGS. 2–6) to its loaded and locking position (FIG. 7), the distal end of locking arm 50 engages angled surface 38 of camming boss 36, and the angled surface facilitates biasing abutment shoulder 52 into aperture 64 of the terminal. In the fully loaded position of the TPA device as shown in FIG. 7, it can be seen that camming boss 36 provides a backing for locking arm 50.

Figure 8:
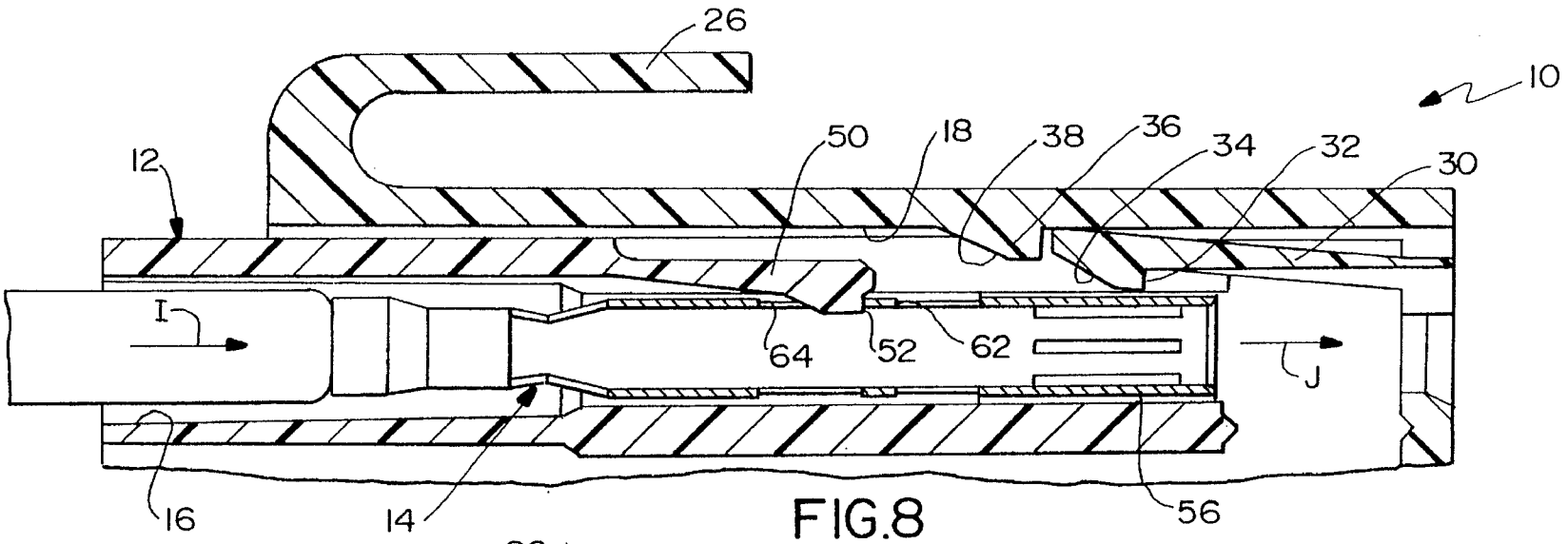
FIG. 8 is a view similar to that of FIGS. 2–7, but with the TPA device engaging an incompletely inserted terminal.

FIG. 8 shows a condition wherein terminal 14 has been inserted into an incomplete position of insertion. With TPA devices of the prior art, such an incompletely inserted terminal would require a technician to search to find which terminal or terminals is incompletely inserted. Such a process wastes considerable time and money in the assembly operation of the connector. However, with TPA device 12 of the invention being in its preloaded position, it can be seen that abutment shoulder 52 on the distal end of locking arm 50 has entered rear aperture 64 of the terminal. Now, upon movement of the TPA device in the direction of arrow "I", the combination of the TPA device along with the terminal will move in the direction of arrow "J" until the terminal reaches its fully inserted position as shown in FIG. 7. Therefore, the TPA device is effective to "correct" situations of incompletely inserted terminals by moving the terminals with the TPA device from its preloaded position to its loaded position (i.e. from the position of FIG. 8 to the position of FIG. 7).

FIG. 8 shows just one incomplete position of insertion of terminal 14 whereupon TPA device 12 is effective to fully insert the terminal when the TPA device is moved from its preloaded position to its loaded position. Other incomplete positions of insertion of the terminal can range from the position shown in FIG. 8 all the way to the position of the terminal shown in FIG. 6. In any position therebetween, movement of the TPA device forwardly will cause abutment shoulder 52 to engage within rear locking aperture 64 of the terminal and move the terminal forwardly with the TPA device.

Figure 9:
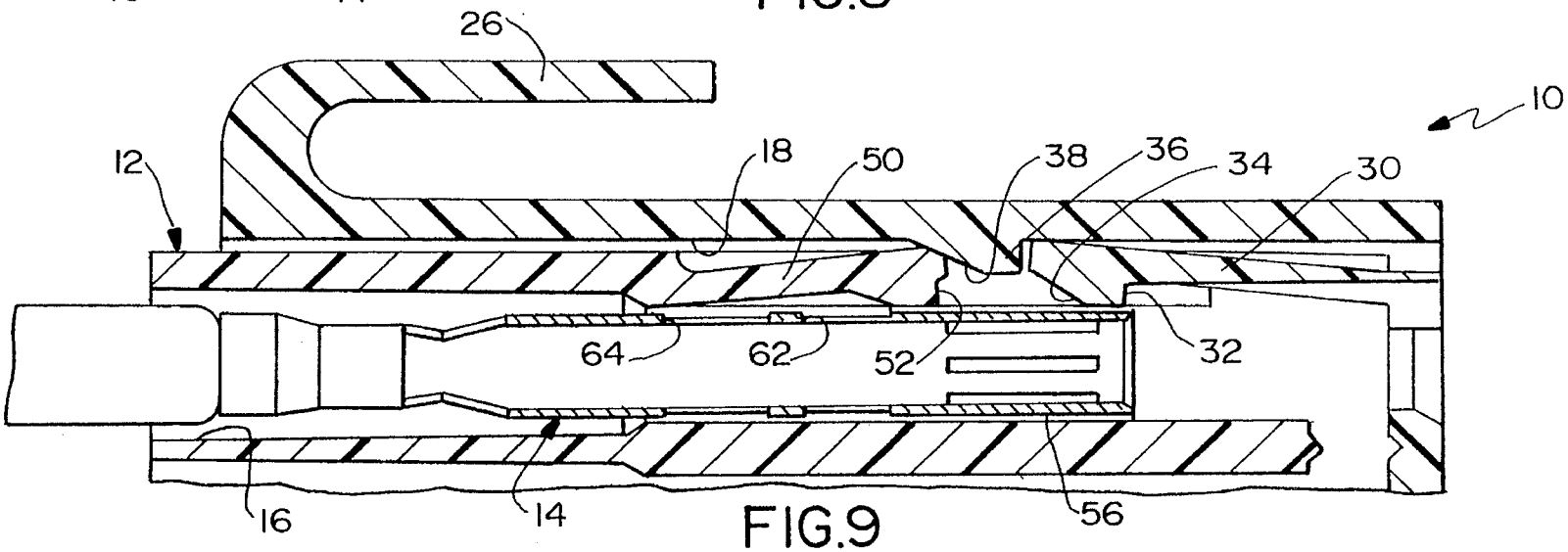
FIG. 9 is a view similar to that of FIGS. 1–8, but showing a terminal in a totally inadequately inserted position rendering the TPA device ineffective.

On the other hand, FIG. 9 shows a position of terminal 14 wherein the terminal is so incompletely inserted (i.e. too far to the rear) that TPA device 12 would be ineffective. In other words, it can be seen in FIG. 9 that the terminal is so far to the rear that the forward distal end of locking arm 50 simply will abut against angled surface 38 of camming boss 16 and jam between the surface and top wall of the terminal.

Figure 10:
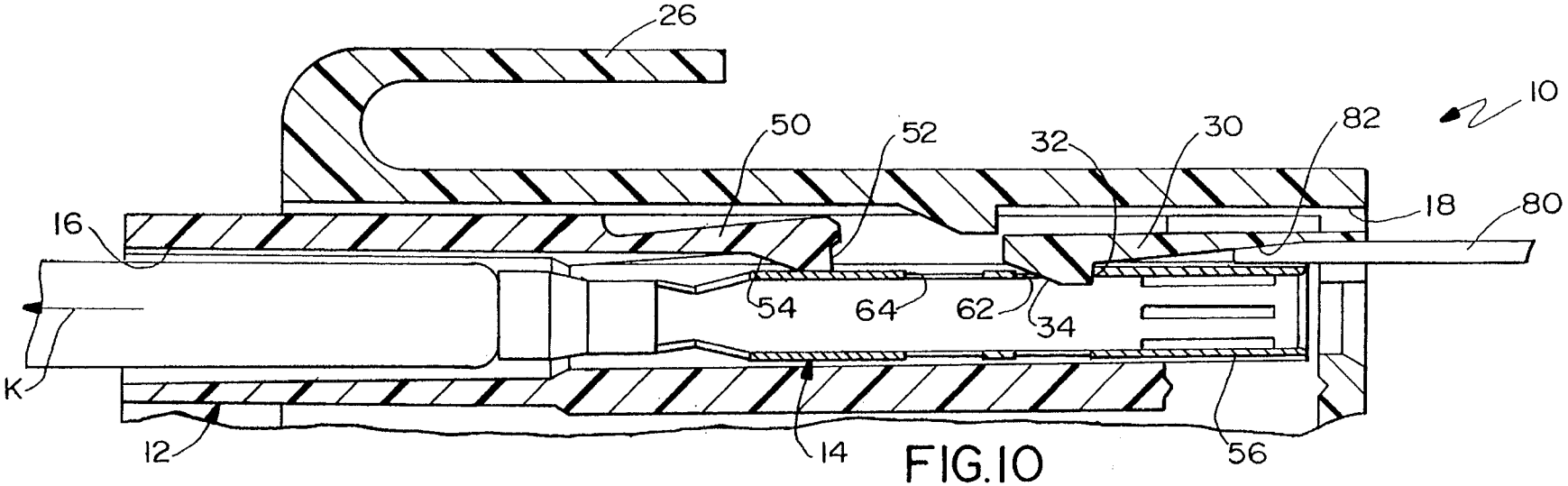
FIG. 10 is a view similar to that of FIGS. 2–9, but with the TPA device withdrawn back to its preloaded position and a probe is inserted for releasing the primary locking arm.
Figure 11:
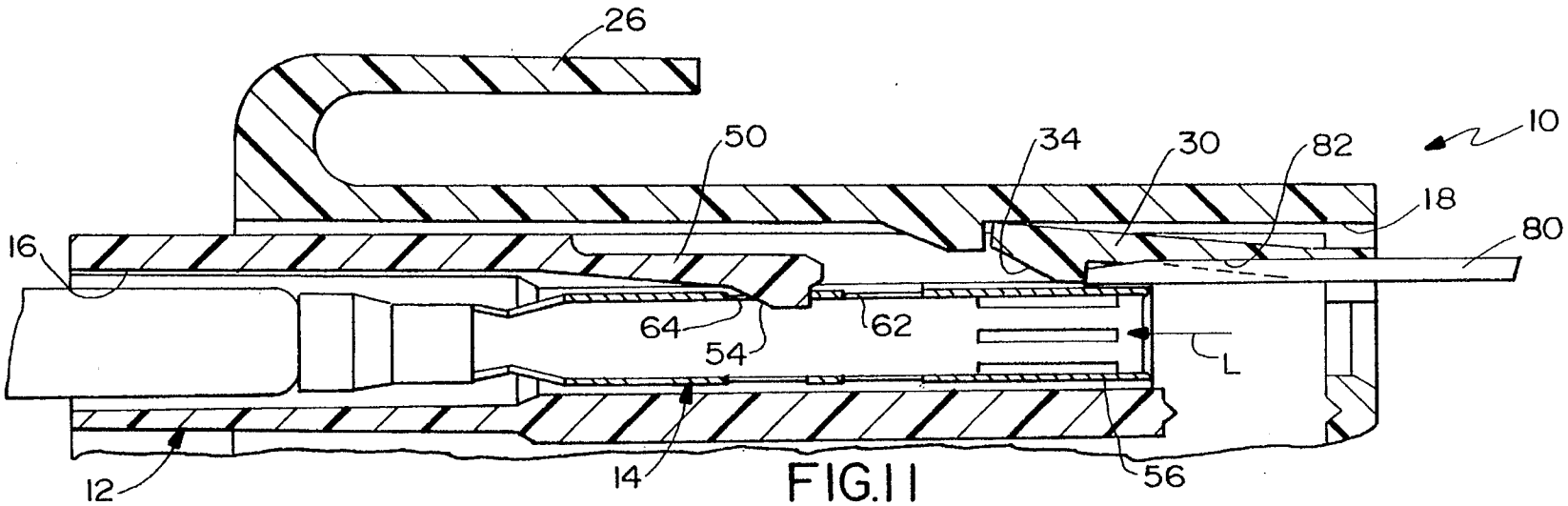
FIG. 11 is a view similar to that of FIG. 10 with the probe inserted further to release the primary locking arm and the terminal withdrawn from its fully inserted position.

Lastly, FIGS. 10–13 show a procedure for selectively withdrawing one or more of terminals 14 from connector 10. In particularly, FIG. 10 shows that TPA device 12 has been moved back rearwardly in the direction of arrow "K" to its preloaded position. During this movement, chamfered surface 54 on the underside of locking arm 50 simply will ride upwardly and over the rear edge of locking aperture 64 as the TPA device is moved back to its preloaded position. A probe-like tool 80 then can be inserted into cavity 18 into engagement with a rear chamfered surface 82 of primary locking arm 30 to lift locking shoulder 52 of the arm out of locking aperture 62 of the terminal as seen in FIG. 11. The terminal then can be moved away from its fully inserted position in the direction of arrow "L" out of locking condition with the primary locking arm, as is seen in FIG. 11.

Figure 12:
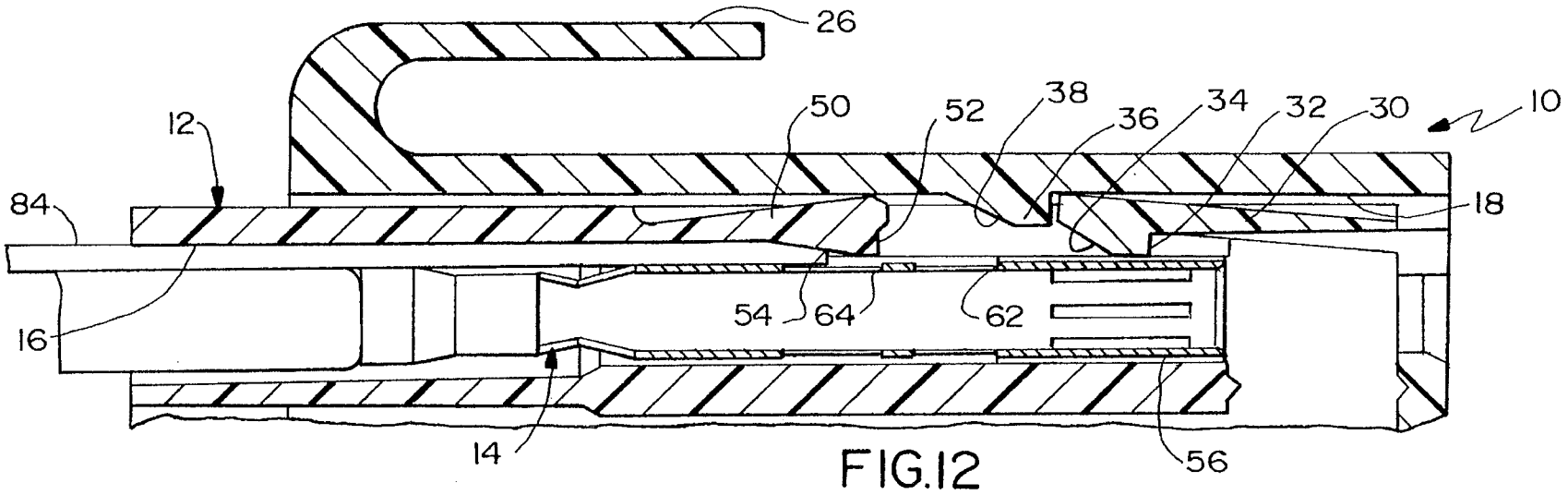
FIG. 12 is a view similar to that of FIG. 11, but with a second probe inserted for releasing the TPA locking arm.
Figure 13:
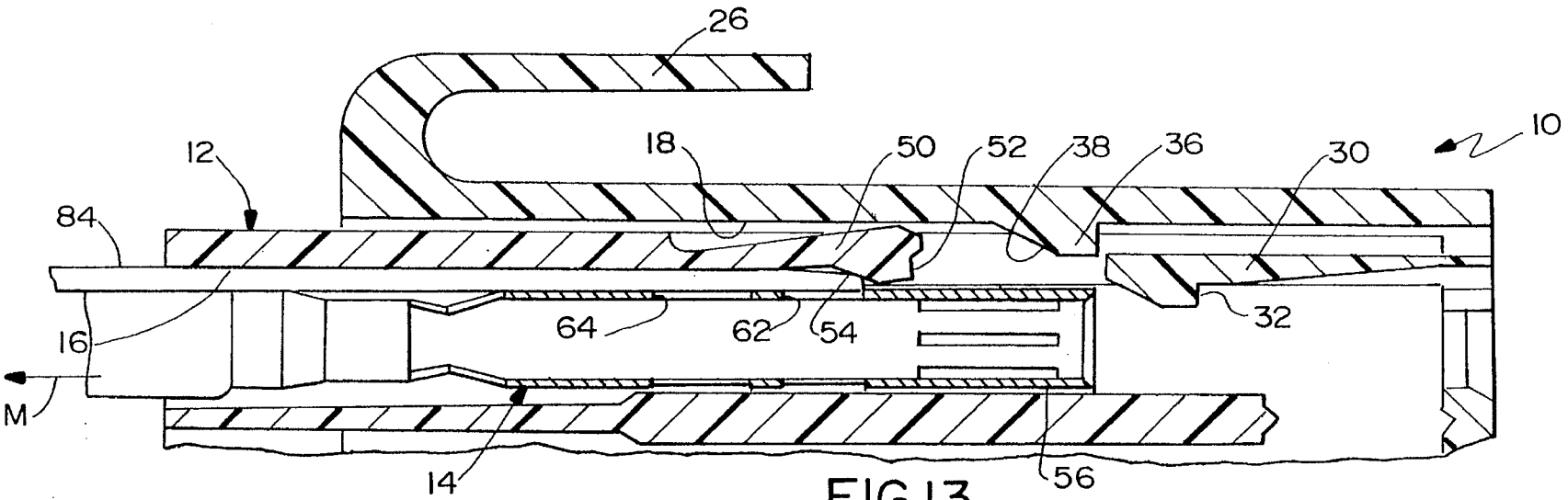
FIG. 13 is a view similar to that of FIG. 12, but showing the terminal being fully withdrawn.

FIG. 12 shows that a second probe 84 then can be inserted into passage 16 and into engagement with angled surface 54 on the underside of TPA locking arm 50 to lift the arm out of locking engagement with the terminal, as shown. The terminal now is free to be fully withdrawn in the direction of arrow "M" in FIG. 13.

A second embodiment of the invention is shown in FIGS. 14–17. Generally, referring first to FIG. 14, a second embodiment of an electrical connector, generally designated 100, includes a housing, generally designated 102, and a TPA device, generally designated 104, selectively engageable with the housing at a rearward terminating end 106 of the housing opposite a forward mating end 108. A plurality of terminals, generally designated 110, are insertable through passages 112 in the TPA device and into a terminal-receiving cavity 114 in housing 102. Only one terminal is shown in the drawings to avoid cluttering a clear depiction of the invention. As with the embodiment of FIGS. 1–13, TPA device 104 is adapted for insertion into terminal-receiving cavity 114 of housing 102, and terminals 110 then are inserted into passages 112 of the TPA device and further into cavity 114 of the housing.

Housing 102 is unitarily molded of dielectric material, such as plastic or the like. Cavity 114 extends in a direction between rearward terminating end 106 and forward mating end 108. The connector housing again includes integral side flanges 116 to facilitate mounting the connector to a panel, and latch means 118 for latching the connector to a complementary mating connector or other connecting device. A pair of grooves 120 are formed in the roof of cavity 114 for receiving a pair of ribs 122 on TPA device 104, and three grooves 124 are formed in the floor of cavity 114 for receiving three ribs 126 on the bottom of the TPA device, for polarization purposes. Contrary to connector housing 20 of the first embodiment shown in FIGS. 1–13, housing 102 of connector 100 does not have a primary locking means within cavity 114 for locking with terminals 110.

Figure 14:
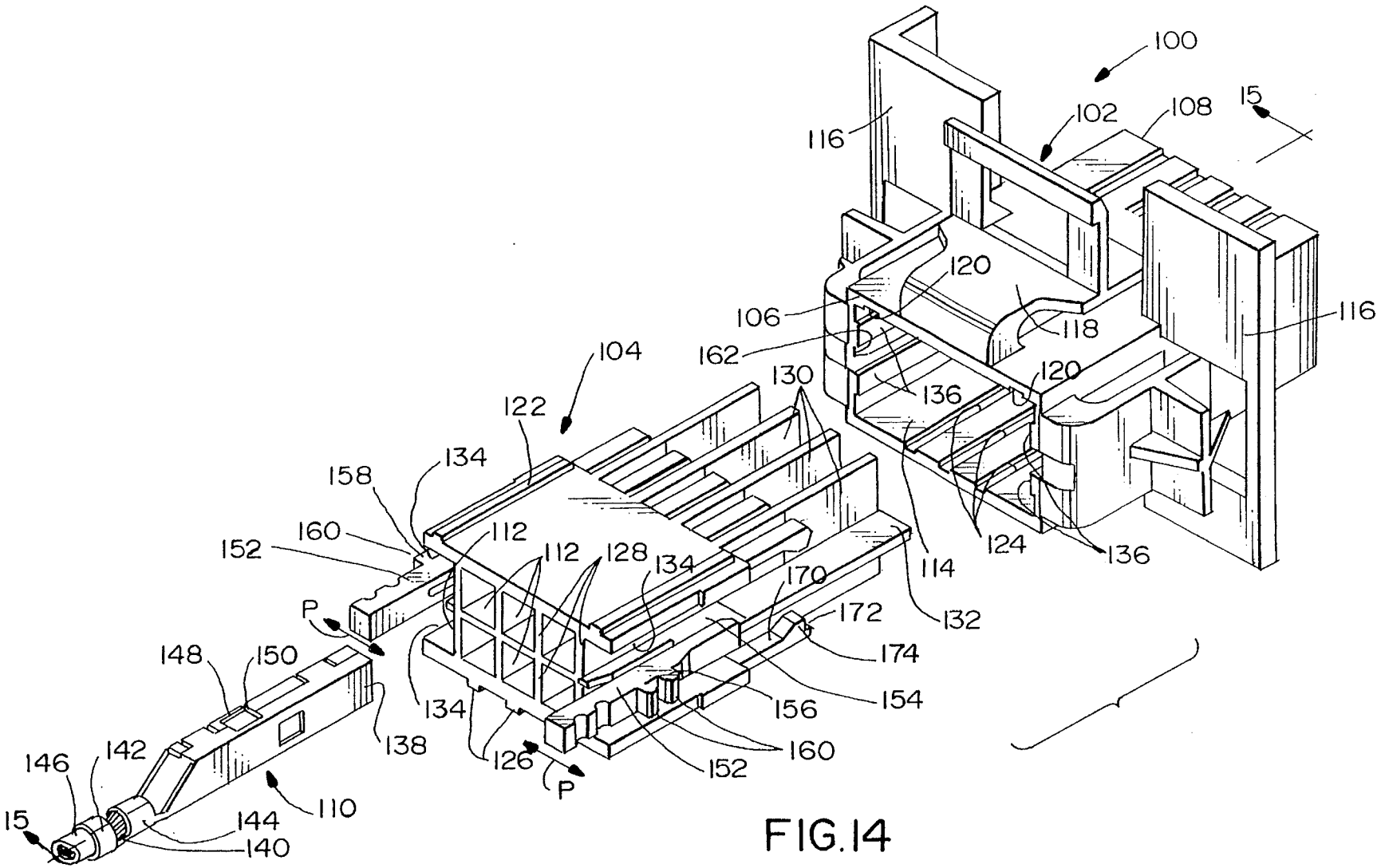
FIG. 14 is an exploded perspective view of a second embodiment of an electrical connector assembly, embodying the concepts of the invention.

Still referring to FIG. 14, TPA device 104 includes rear walls 128 and front partitions 130 for separating terminal-receiving passages 112. Again, two rows of passages are divided transversely of the TPA device by a central wall 132. It should be noted that the two outermost passages 112 at each opposite side of the TPA device are open, as at 134 which exposes the two outermost terminals located in those passages. By eliminating the outside walls of the TPA device, the width of the device is shortened, and the overall size of the envelope for connector 10 is reduced.

In order to prevent the exposed outermost terminals from moving laterally outwardly or from twisting about their longitudinal axis, elongated ribs 136 are formed on the inside of each side wall of cavity 114 in housing 102. These ribs 136 define blocking means on housing 102 within cavity 114 aligned with the open passages, as at 134, of the TPA device. In effect, ribs 136 are engageable by the exposed terminals in the outermost open passages to prevent lateral or twisting movement of the exposed terminals.

Each terminal 110 has a forward mating end 138 and a rear terminating end 140. The forward mating end is generally box-shaped for defining a receptacle to receive a mating male terminal of the complementary connecting device. Terminating end 140 includes two pairs of crimp arms 142 and 144 for crimping onto an electrical wire or cable 146. The terminal includes a locking aperture 148 defining a forward abutment shoulder or edge 150.

Generally, complementary interengaging holding means are provided between TPA device 104 and housing 102 for holding the TPA device in either of a preloaded position or a fully loaded position, as well as allowing the TPA device to be readily removed from the housing along with the terminals therewith. More particularly, a flexible cantilevered latch arm 152 is integrally molded with the TPA device at each opposite side thereof. The arms flex about living hinges 152 in the direction of double-headed arrows "P". Each cantilevered latch arm has a pair of outwardly projecting latch bosses 156 and 158, each having chamfered camming edges 160. The latch bosses are engageable behind latch shoulders 162 of housing 102 within cavity 114 thereof, at opposite sides of the cavity. Only one latch shoulder 162 is visible in FIG. 14. These latch bosses 156 and 158, along with latch shoulders 162, define two positions of the TPA device relative to housing 102, a preloaded position and a fully loaded position. Latch bosses 156 are effective to define the preloaded position of the TPA device relative to the housing, and latch bosses 158 are effective to define the fully loaded position of the TPA device relative to the housing.

Figure 15:
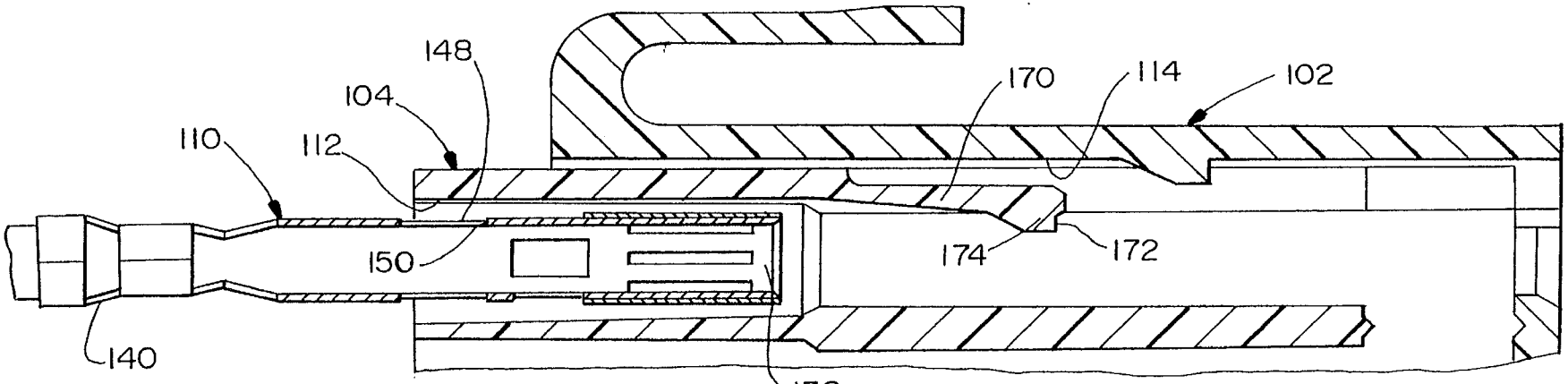
FIG. 15 is a vertical section taken generally along line 15—15 of FIG. 1, but with the TPA device assembled to the connector in its preloaded position and with the terminal just partially inserted.

In operation of the second embodiment of the invention shown in FIGS. 14–17, reference is made first to FIG. 15 wherein TPA device 104 is shown selectively engaged with housing 102, inserted into cavity 114 and located in its preloaded position relative to the housing. In other words, latch bosses 156 (FIG. 14) will be engageable with latch shoulders 162. Terminal 110 is shown being initially inserted into its respective passage 112 of the TPA device.

Referring to FIG. 15 in conjunction with FIG. 14, TPA device 104 includes a flexible locking arm 170 located within and projecting forwardly of each terminal-receiving passage 112. The locking arm has a forwardly facing abutment shoulder 172 on the distal end thereof. The locking arm defines an enlarged head portion 174 which locks into aperture 148 of a respective terminal, as will be described hereinafter. The locking arm is sufficiently stiff to pull the terminal with the TPA device back out of housing 102, for purposes described below.

Figure 16:
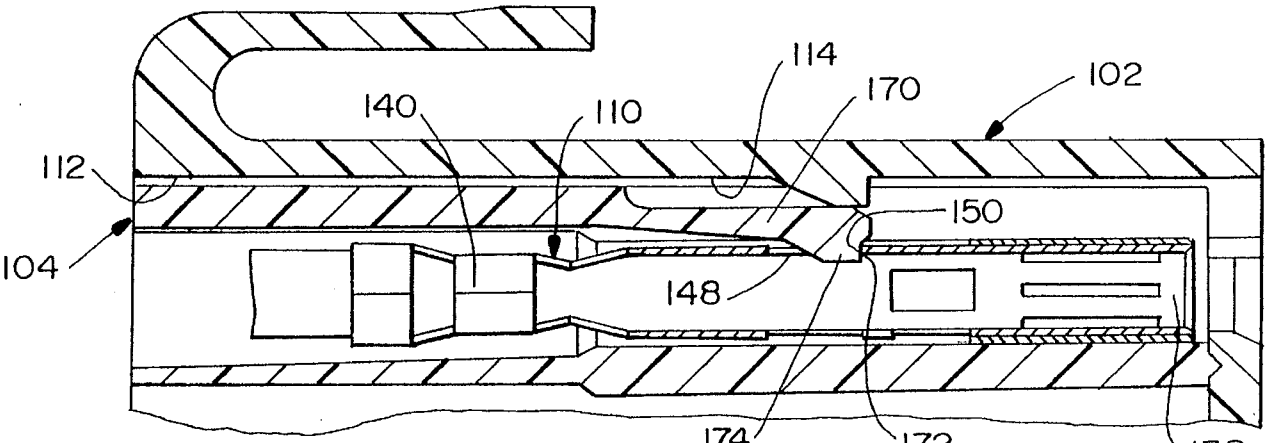
FIG. 16 is a view similar to that of FIG. 15, but with the TPA device and terminal moved to the fully loaded position.

FIG. 16 shows TPA device 104 in its fully loaded or inserted position within cavity 114 of housing 102. Terminal 110 also is shown in its fully inserted position. It can be seen that locking arm 170 has moved to a position wherein abutment shoulder 172 has entered locking aperture 148 of the terminal and into engagement with abutment shoulder 150 at the forward edge of the aperture.

Between the preloaded position of TPA device 104 and the initially inserted position of terminal 110 in FIG. 15, and the fully loaded position of the TPA device and the fully inserted position of the terminal shown in FIG. 16, the operation of the second embodiment is the same as described above in relation to the first embodiment, except for the omission of the primary locking means provided by primary locking arm 30 of the first embodiment. In the second embodiment, the TPA device is effective to move the terminal from at least one incomplete position of insertion to its fully inserted position in response to engaging locking arm 170 with the terminal, as was described above with the first embodiment.

Figure 17:
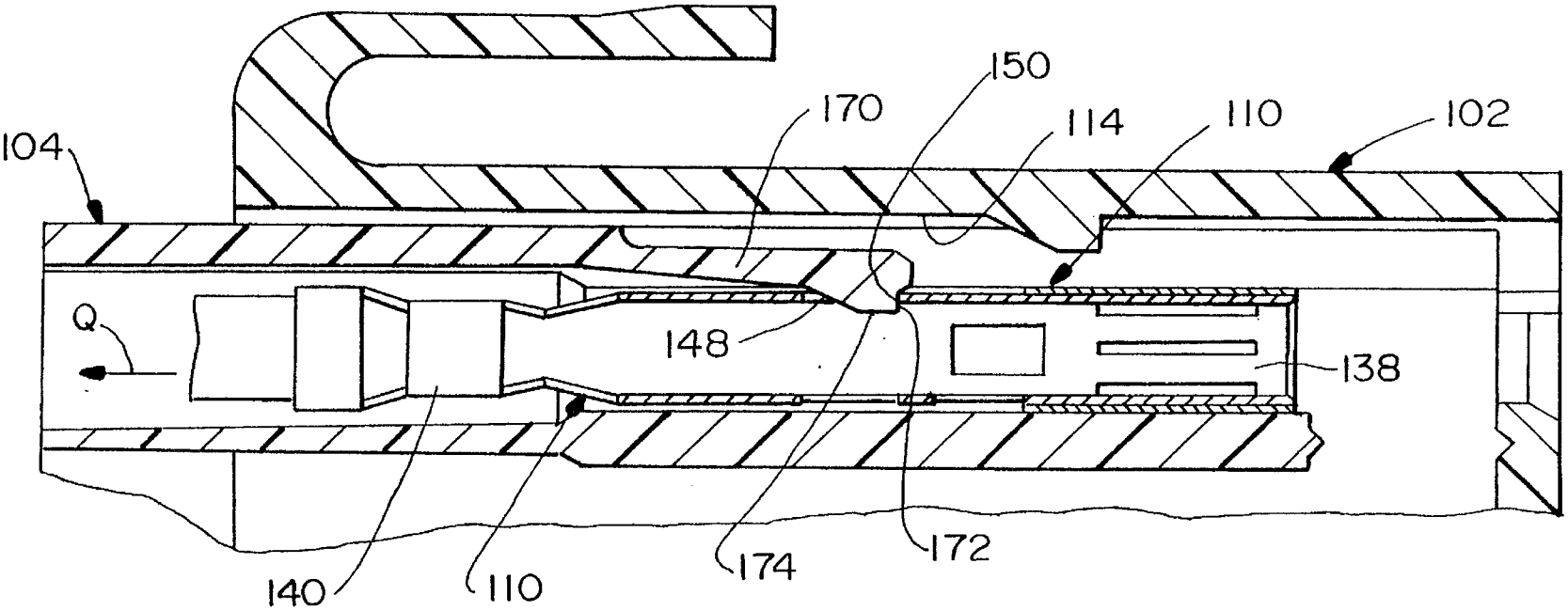
FIG. 17 is a view similar to that of FIGS. 15 and 16, but with the TPA device withdrawn back to its preloaded position pulling the terminals therewith.

FIG. 17 shows TPA device 104 having been moved back outwardly in the direction of arrow "Q" from its fully loaded position of FIG. 16 back to its preloaded position of FIG. 15. It can be seen that terminal 110 has been moved back outwardly with the TPA device. By providing latch bosses 156 and 158 (FIG. 14) on flexible cantilevered latch arms 152, the latch arms can be pinched inwardly to allow the latch bosses to clear latch shoulders 162 within cavity 114 of housing 102. This allows the entire TPA device, along with all of the terminals within passages 112 of the TPA device, to be readily removed from housing 102 for servicing purposes. The assembly of the TPA device and the terminals can be removed from the housing to inspect the assembly, to correct any problems or to replace any terminals. This method of using connector 100 is quite advantageous and is not afforded by connector 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing having a forward mating end and a rearward terminating end and a terminal-receiving cavity extending in a direction between the ends;

a terminal insertable into the cavity from the rearward terminating end of the housing;

a TPA device selectively engageable with the housing in two positions, preloaded and fully loaded, at said terminating end of the housing with a terminal retention portion in locking engagement with the terminal;

complementary interengaging abutment means between the terminal and the TPA device for moving the terminal from at least one incomplete position of insertion to a fully inserted position in response to moving the TPA device from the preloaded position to the fully loaded position thereof; and complementary interengaging holding means between the TPA device and the housing for holding the TPA device in either of said preloaded and fully loaded positions and allowing the TPA device to be readily removed from the housing along with the terminal, said complementary interengaging holding means comprises a flexible latch arm cantilevered from each of two opposite sides of the TPA device and releasably engageable with complementary latch means on the housing, said latch arms being conjointly pinchable inwardly by an operator to effect removal of the TPA device and terminal from the housing.

2. The electrical connector of claim 1 wherein said complementary interengaging abutment means include an abutment portion on the retention portion of the TPA device.

3. The electrical connector of claim 1 wherein said retention portion of the TPA device includes an abutment shoulder for engaging the terminal, the abutment shoulder, in turn, comprising part of said complementary interengaging abutment means.

4. The electrical connector of claim 1 wherein said retention portion of the TPA device comprises a flexible locking arm having said abutment shoulder thereon.

5. The electrical connector of claim 4 wherein said complementary interengaging abutment means include an aperture in the terminal engageable by said abutment shoulder.

6. The electrical connector of claim 1 wherein when the TPA device is preloaded the terminal can be inserted into the cavity, and when the TPA device is fully loaded the retention portion locks the terminal in its fully inserted position.

7. The electrical connector of claim 1 wherein said TPA device includes a terminal-receiving passage aligned with the terminal-receiving cavity of the housing.

8. An electrical connector, comprising:

a housing having a forward mating end and a rearward terminating end and a cavity extending in a direction between the ends;

a TPA device selectively engageable with the housing at said terminating end thereof with terminal engaging means insertable into the cavity, the TPA device including a plurality of longitudinal terminal-receiving passages with at least some of the passages being open lengthwise thereof at least at one side of the TPA device;

a plurality of terminals positionable in the terminal-receiving passages in the TPA device with some of the terminals being exposed through said open passages at said at least one side of the TPA device; and blocking means on the housing within the cavity and aligned with said open passages and engageable by the exposed terminals to prevent lateral movement of the exposed terminals.

9. The electrical connector of claim 1 wherein some of said passages are open at each of two opposite sides of the TPA device exposing terminals thereat.

10. The electrical connector of claim 1 wherein said blocking means comprise elongated ribs integrally formed with the housing within the cavity.

* * * * *

UNITED STATES PATENT AND TRADEMARK OFFICE

Certificate

Patent No. 5,622,521 Patented: April 22, 1997

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Scott P. Marceau, Kenneth T. Stead and Alfred H. Plummer, IV.

Signed and Sealed this Nineteenth Day of September, 2000.

BRIAN W. BROWN
*Special Program Examiner*
Technology Center 2800